US007845052B2

(12) United States Patent
Chang et al.

(10) Patent No.: US 7,845,052 B2
(45) Date of Patent: Dec. 7, 2010

(54) SHEATH TYPE ROTATING AXEL STRUCTURE

(75) Inventors: Jui-Hung Chang, Sinjhuang (TW); Chun-Hung Hu, Sinjhuang (TW)

(73) Assignee: Jarllytec Co., Ltd., Taipei County (TW)

( * ) Notice: Subject to any disclaimer, the term of this patent is extended or adjusted under 35 U.S.C. 154(b) by 271 days.

(21) Appl. No.: 12/253,633

(22) Filed: Oct. 17, 2008

(65) Prior Publication Data

US 2009/0151123 A1 Jun. 18, 2009

(30) Foreign Application Priority Data

Oct. 17, 2007 (TW) ..... 96138810

(51) Int. Cl.
*E05D 11/08* (2006.01)
*E05C 17/64* (2006.01)

(52) U.S. Cl. ..... 16/342; 16/375

(58) Field of Classification Search ..... 16/337–339, 16/342, 330, 303, 374, 376, 377, 340, 375; 361/679.11, 679.12, 679.27; 455/90.3, 575.1, 455/575.3, 575.8; 379/433.12, 433.13; 348/373, 348/333.01, 333.06, 794
See application file for complete search history.

(56) References Cited

U.S. PATENT DOCUMENTS 1,903,251 A * 3/1933 Ahrens ..... 16/375
4,614,181 A * 9/1986 Karlsson ..... 602/16
5,832,566 A * 11/1998 Quek et al. ..... 16/342
6,149,212 A * 11/2000 Kuntz et al. ..... 292/288
6,832,411 B2 * 12/2004 Koshikawa et al. ..... 16/330
7,047,599 B2 * 5/2006 Oshima et al. ..... 16/337
7,549,193 B2 * 6/2009 Lee et al. ..... 16/342
2002/0042971 A1 * 4/2002 Liao ..... 16/342
2002/0144378 A1 * 10/2002 Liao ..... 16/342
2007/0101543 A1 * 5/2007 Lu et al. ..... 16/342

FOREIGN PATENT DOCUMENTS

JP 2005023951 A * 1/2005

* cited by examiner

*Primary Examiner*—Chuck Y. Mah
(74) *Attorney, Agent, or Firm*—Guice Patents PLLC

(57) ABSTRACT

A sheath type rotating axle structure is disclosed, comprising an axle receiver disposed with a slanted corner which is further formed to have a notch therein; a sheath part disposed with a sheath end and an extending end, wherein a flute is formed at the sheath end and a rim and an annular groove are disposed between the sheath end and the extending end; and a pivotal axle pivotally connected the sheath end, disposed at its front end with a protruding ring, and embeddingly engaged with an axle hole of a fixed base at its rear end, wherein the extending end of the sheath part may be securingly mounted onto the notch of the axle receiver and the protruding ring of the pivotal axle may be abutted against the rim and the annular groove of the sheath part such that the sheath part may generate frictional torque against the pivotal axle when the axle receiver is rotated with respect to the fixed base. With the implementation of the present invention, the pivotal axle, the sheath part, and the axle receiver can be prevented from disconnecting.

10 Claims, 6 Drawing Sheets

A-A

SHEATH TYPE ROTATING AXEL STRUCTURE

FIELD OF THE INVENTION

The present invention relates to a rotating axle structure, and more particularly to a sheath type rotating axle structure can strengthen the fixing stability of the components involved and prevent them from disconnecting.

BACKGROUND OF THE INVENTION

Consumer electronics with flip covers, such as portable computer, electronic dictionary, portable audio/video player, flip mobile phone, generally have a main body on the bottom, which is pivotally connected to the cover body on the top with a hinge structure (or called rotating axle), such that the cover body may swing open or close with respect to the main body. Therefore, the rotating axle is key to the quality of the products described above.

"TRIPPING-PREVENTION HINGE STRUCTURE," as shown in FIG. 2, is invented by the applicant and disclosed in the ROC Patent M289875 on Apr. 21, 2006 (equivalent to that disclosed in China Patent 200520142261.3). In the patent, the lower bending plate 201 of the collar 20 is engaged onto the annular groove 102 of the axle 10 to prevent them from disconnecting. Also, after the axle rod 111 of the axle 10 is insertingly connected onto the collar 20, both of them are embeddingly engaged with the axle hole 301 of the axle receiver 30, so as to render the axle 10 rotating with respect to the axle receiver 30 and in turn generating frictional torque.

Although the conventional rotating axle structure can prevent the axle 10 and the collar 20 from disconnecting, when the space for the structure is restricted, in the case of adopting thin design, the thickness of the axle receiver 30 is limited and thus its external is needed to form an axial opening to expose part of the collar 20. Consequently, the design of structure has to take into account in preventing the collar 20 from disconnecting with the axle receiver 30; moreover, the frictional torque the rotating axle demanded has to be further strengthened. These drawbacks demand urgent attention.

SUMMARY OF THE INVENTION

In view of the foregoing shortcomings of the prior art the inventor of the present invention based on years of experience in the related industry to conduct extensive researches and experiments with an attempt to overcome the possible disconnection of the collar and the axle receiver due to the axial opening formed to meet the demand of thin design, and finally invented a sheath type rotating axle structure in accordance with the present invention.

The objective and the improved function are characterized in forming a slanted corner to increase the frictional area for generating torque to achieve the frictional torque required for a rotating axle structure and to enhance the fixing stability of the components involved to prevent them from disconnecting.

To achieve the objectives described above, one technical approach adopted in the present invention is primarily to provide a sheath type rotating axle structure, comprising an axle receiver disposed with a slanted corner which is further formed to have a notch therein; a sheath part disposed with a sheath end and an extending end, wherein a flute is formed at the sheath end and a rim and an annular groove are disposed between the sheath end and the extending end; and a pivotal axle pivotally connected the sheath end, disposed at its front end with a protruding ring, and embeddingly engaged with an axle hole of a fixed base at its rear end, wherein the extending end of the sheath part may be securingly mounted onto the notch of the axle receiver and the protruding ring of the pivotal axle may be abutted against the rim and the annular groove of the sheath part such that the sheath part may generate frictional torque against the pivotal axle when the axle receiver is rotated with respect to the fixed base.

Another technical approach adopted in the present invention is primarily to provide a sheath type rotating axle structure comprising an axle receiver disposed with a slanted corner; a fixed base disposed with a slanted corner; a sheath part disposed with a sheath end and an extending end, wherein a flute is formed at the sheath end and a rim and an annular groove are disposed between the sheath end and the extending end; and a pivotal axle pivotally connected the sheath end, disposed at its front end with a protruding ring, and embeddingly engaged with an axle hole of a fixed base at its rear end, wherein the extending end of the sheath part may be securingly mounted onto the notch of the axle receiver and the protruding ring of the pivotal axle may be abutted against the rim and the annular groove of the sheath part such that the sheath part may generate frictional torque against the pivotal axle when the axle receiver is rotated with respect to the fixed base.

Refer to the figures for the further disclosure of the technical contents of the present invention, wherein FIG. 1 is an exploded perspective view of a conventional rotating axle structure; FIG. 2 is an exploded perspective view of a rotating axle structure in accordance with the present invention; FIG. 3 is an exploded perspective view of a rotating axle structure along a different view angle in accordance with the present invention; FIG. 4 is an assembled perspective view of the present invention; FIG. 5 is a cross-sectional view taken from the A-A line in FIG. 4; and FIG. 6 is a drawing of partial enlargement of the cross-sectional view in FIG. 5.

To make it easier for our examiner to understand the objective of the invention, its structure, innovative features, and performance, we use a preferred embodiment together with the attached drawings for the detailed description of the invention.

DETAILED DESCRIPTION OF THE PREFERRED EMBODIMENTS

The structure, technical measures and effects of the present invention will now be described in more detail hereinafter with reference to the accompanying drawings that show various embodiments of the invention.

Figure 1:
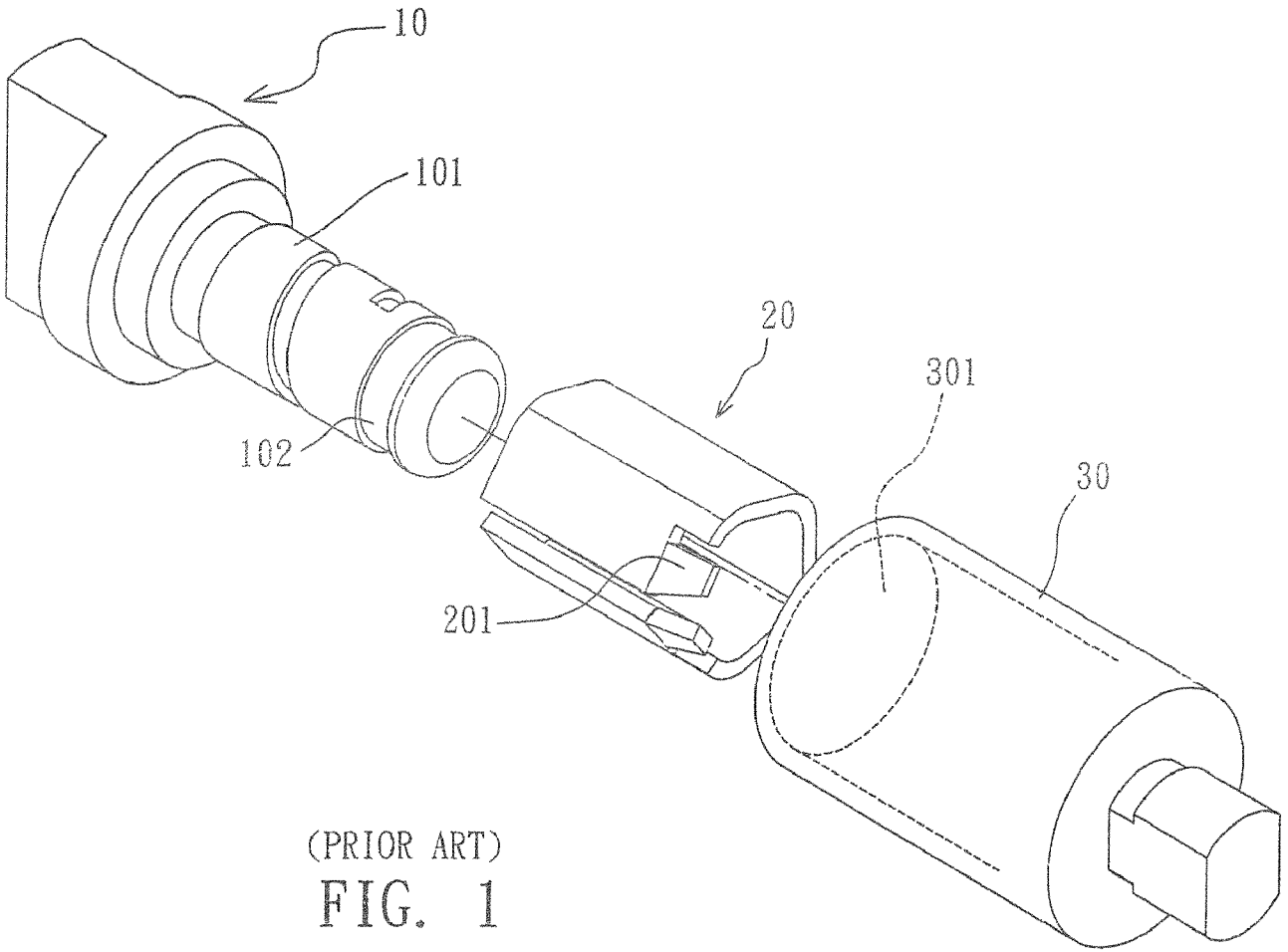
(PRIOR ART) FIG. 1
FIG. 1 is an exploded perspective view of a conventional rotating axle structure.
Figure 2:
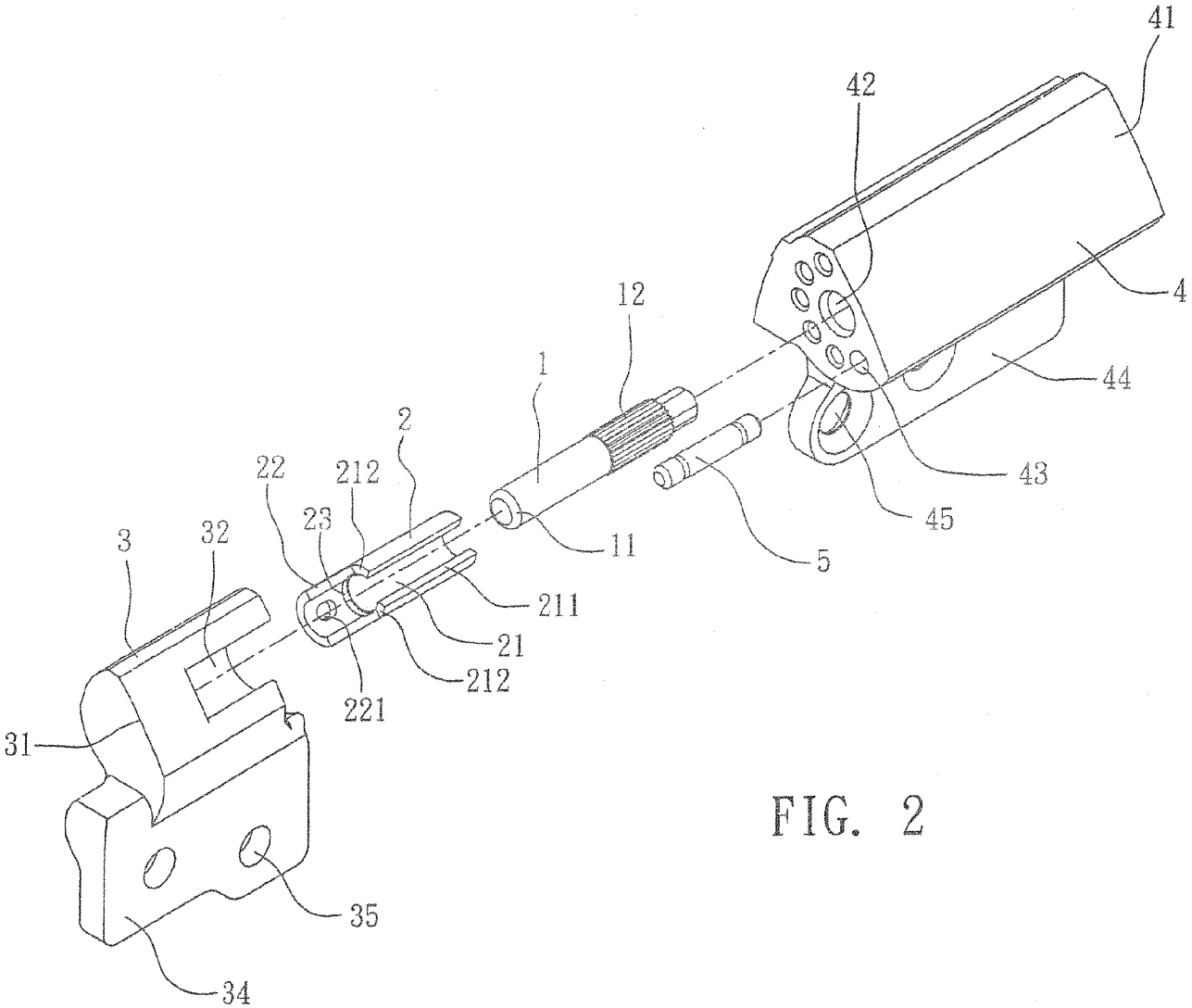
FIG. 2 is an exploded perspective view of a rotating axle structure in accordance with the present invention.
Figure 3:
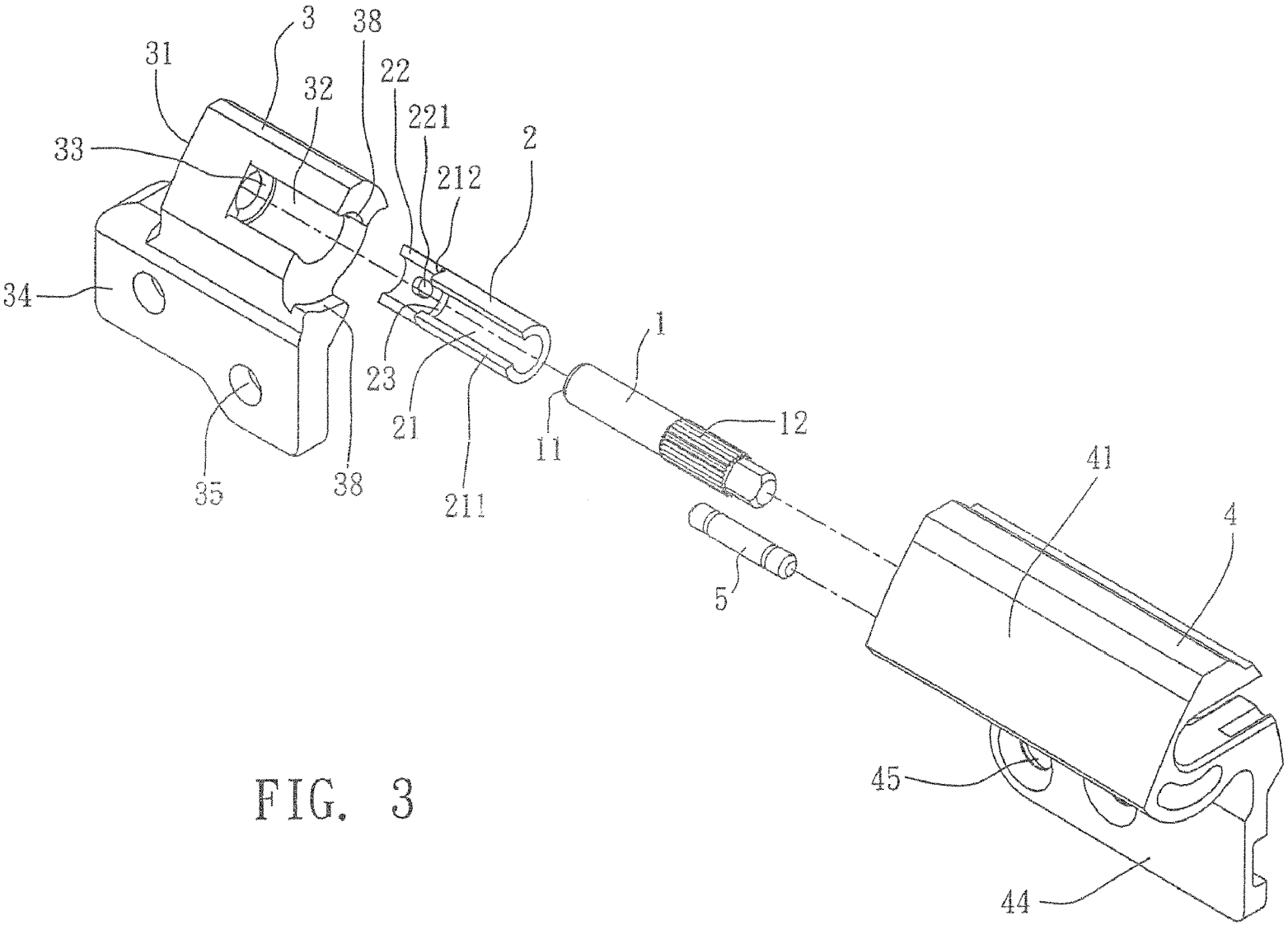
FIG. 3 is an exploded perspective view of a rotating axle structure along a different view angle in accordance with the present invention.
Figure 4:
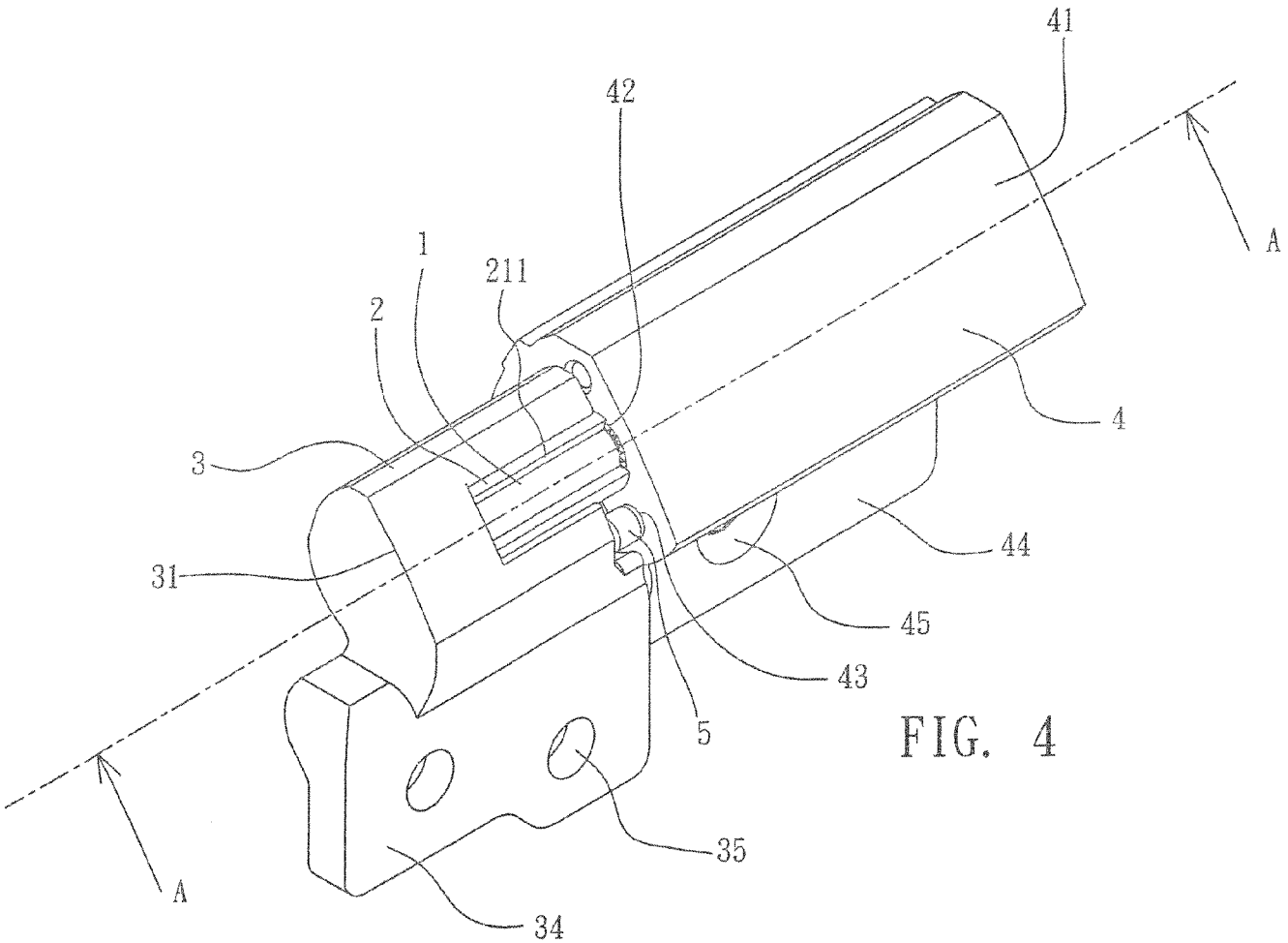
FIG. 4 is an assembled perspective view of the present invention.

With reference to FIGS. 2 to 4, a sheath type rotating axle structure according to the present invention comprises a pivotal axle 1, a sheath part 2, and an axle receiver 3, wherein the pivotal axle 1 is further mounted onto a fixed base 4.

The pivotal axle 1 is a rod comprising a protruding ring 11 on its one end to be engaged onto the sheath part 2 described later so as to prevent the pivotal axle 1 and the sheath part 2 from disconnecting axially. The other end of the pivotal axle 1 is disposed with an embossing surface 12 or a protruding rib, which is installed onto the fixed base 4 described later by press fit, such that the pivotal axle 1 is remained in a firmly secured condition.

The sheath part 2 is made of hard material, a hollow flexible cylinder made of stainless steel for example, to meet the restriction imposed by the thin design of the axle receiver 3 described later. Consequently, the external surface of the sheath part 2 is formed to have a flute 21 and thus the two free ends of the sheath part 2 form a respective sheath end 211 such that the pivotal axle 1 is embeddingly engaged with and received in the sheath part 2. The pivotal axle 1 experiences also the radial compression of the sheath end 211, thereby generating frictional torque. As described earlier, to prevent the pivotal axle 1 and the sheath part 2 from disconnecting, the sheath part 2 protrudes along the direction of the axle receiver 3 to form an extending end 22. An annular groove 23 is disposed between the extending end 22 and the sheath part 2 to engage onto the protruding ring 11. The rear end of the protruding ring 11 is pushed against the rims 212 of the two sheath ends 211. Further, the extending end 22 is formed at least a fixed hole 221 to render the sheath part 2 securingly mounted in the axle receiver 3.

The axle receiver 3 is a base body, which may be made of soft metal, formed by die casting of zinc alloy for example. To meet the restriction in space under the thin-design demand, the axle receive 3 is formed to have a slanted corner 31 at its external surface and to have an external opening 32 to reduce the thickness of the axle receiver 3. When the present invention is being assembled, the sheath part 2 is embeddingly engaged with the external opening 32 to expose part of the sheath ends 211. To obtain the desired frictional torque for the rotating axle structure and enhance the fixing stability of the components involved, the external opening 32 is axially formed to have an notch 33 axially (shown in FIG. 3) for the insertion and fixing of the extending end 22 of the sheath part 2. To integrate the sheath part 2 and the axle receiver 3 as a single body, the external of the axle receiver 3 is punched to have a punch hole 36, and in turn a protruding portion 37 correspondingly formed along the notch 33, so as to secure the fixed hole 221 of the extending end 22.

To enable the axle receiver 3 connected with an object, the cover body of a notebook computer for example, a connection end 34 is disposed on the axle receiver 3, which is at least provided with a connection hole 35.

The fixed base 4 is also a base body, formed by die casting of zinc alloy for example. The fixed base 4 is also formed to have a slanted corner 41 corresponding to the slanted corner 31 of the axle receiver 3. After the present invention is assembled, the two slanted corners 31 and 41 form an integrated slant surface. The fixed base 4 is axially formed to have an axial hole 42 for embedding engagement and fixing the embossing surface 12 or a protruding rib on one end of the pivotal axle 1. Further, to limit the rotation angle of the axle receiver 3 upon swinging open or close, a plurality of pin holes 43 are disposed around the axial hole 42 of the fixed base 4 for inserting the locating part 5 and adjusting its inserting position. The axle receiver 3 is disposed with a stopping portion 38 adjacently connected with the locating part 5. When the axle receiver 3 is rotated with respect to the fixed base 4, the locating part 5 may be abutted against the stopping portion 38 so as to limit the rotating angle of the pivotal axle 1. The locating part 5 is a locating pin when an actual embodiment is made.

To enable the fixed base 4 connected with another object, the main body of a notebook computer, a linking end 44 is disposed, on which at least a linking hole 45 is provided.

Figure 5:
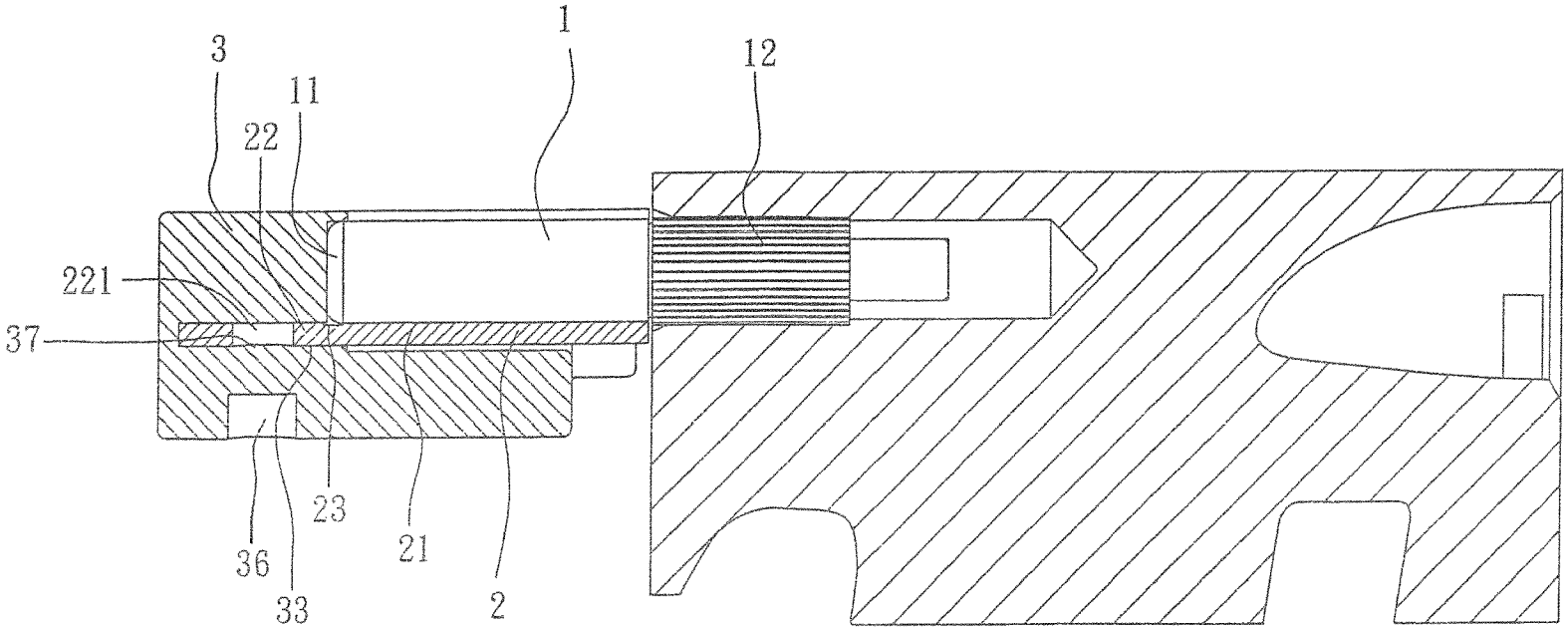
FIG. 5 is a cross-sectional view taken from the A-A line in FIG. 4.
Figure 6:
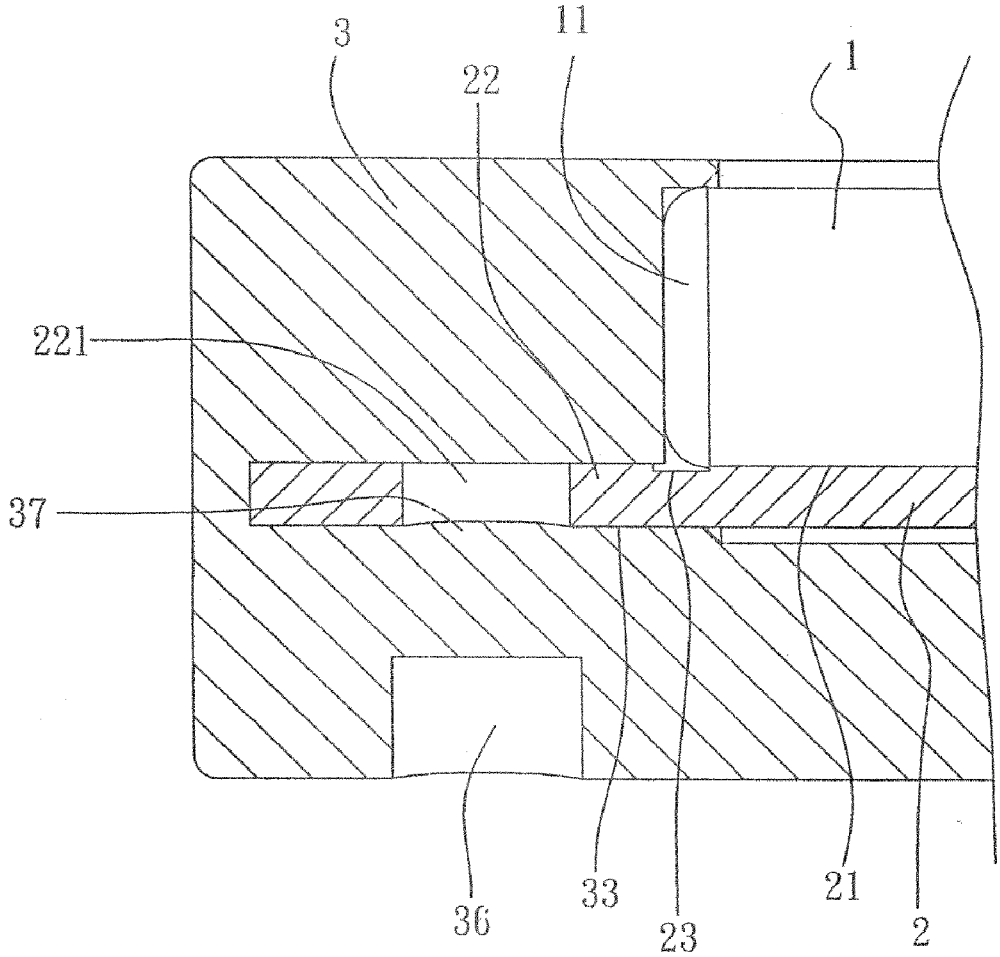
FIG. 6 is a drawing of partial enlargement of the cross-sectional view in FIG. 5.

The assembled perspective view of the present invention is shown in FIG. 4. After the present invention is assembled, the arrangement of the components involved is shown in FIG. 5, a cross-sectional view, and FIG. 6, the partial enlargement view of FIG. 5, in which the connection of the axle receiver 3 and the sheath part 2 is emphasized. For example, the external of the axle receiver 3 is punched to form a punched hole 36 with some fixtures and in turn the protruding portion 37 is formed inside the notch 33, so as to secure the fixed hole 221 of the extending end 22.

Consequently, in the implementation of the present invention, since the axle receiver 3 is disposed with the external opening 32, the sheath end 211 of the sheath part 2 is partially exposed, the extending end 22 of the sheath part 2 is securingly mounted onto the notch 33 of the axle receiver 3 to provide the frictional torque required for the rotating axle structure and enhance fixing stability of the components involved. The protruding ring 11 of the pivotal axle 1 is abutted against the rims 212 and annular groove 23 of the sheath part 2 to prevent the pivotal axle 1, the sheath part 2, and the axle receiver 3 from disconnecting. Further, when the axle receiver 3 is rotated with respect to the fixed base 4, the sheath part 2 can generate frictional torque relative to the pivotal axle 1, which is indeed a novelty not seen before in the prior art.

The present invention provides a feasible solution, and a patent application is duly filed according accordingly. However, it is to be noted that the preferred embodiments disclosed in the specification and the accompanying drawings are not intended to limit the invention. To the contrary it is intended to cover various modifications and similar arrangements and procedures, and thus the scope of the appended claims should be accorded the broadest interpretation so as to encompass all such modifications and similar arrangements and procedures.

What is claimed is:

1. A sheath type rotating axle structure, comprising:

an axle receiver disposed with a slanted corner which is further formed to have a notch therein;

a sheath part disposed with a sheath end and an extending end, wherein a flute is formed at the sheath end and a rim and an annular groove are disposed between the sheath end and the extending end; and a pivotal axle pivotally connected the sheath end, disposed at its front end with a protruding ring, and embeddingly engaged at its rear end with an axle hole of a fixed base, wherein the extending end of the sheath part is securingly mounted onto the notch of the axle receiver and the protruding ring of the pivotal axle is abutted against the rim and the annular groove of the sheath part;

such that the sheath part can generate frictional torque against the pivotal axle when the axle receiver is rotated with respect to the fixed base.

2. The sheath type rotating axle structure as defined in claim 1, wherein the extending end of the sheath part is disposed with a fixed hole and the external of the axle receiver is formed to have a punch hole so as to form a protruding portion along the notch to secure the fixed hole of the extending end.

3. The sheath type rotating axle structure as defined in claim 1, wherein the axle receiver is further disposed with a stopping portion on one end and the fixed base is further disposed with a locating part, such that when the axle receiver is rotated with respect to the fixed base, the locating part of the fixed base is abutted against the stopping portion of the axle receiver to limit the rotating angle of the pivotal axle.

4. The sheath type rotating axle structure as defined in claim 1, wherein the axle receiver is further disposed with a stopping portion on one end and, a plurality of pin holes are annularly formed on the fixed base for inserting a locating pin and adjusting its inserting position of the locating part, such that when the axle receiver is rotated with respect to the fixed base, the locating pin is abutted against the stopping portion so as to limit the rotating angle of the pivotal axle.

5. The sheath type rotating axle structure as defined in claim 1, wherein the rear end of the pivotal axle is further disposed with an embossing surface or a protruding rib such that the pivotal axle is embeddingly engaged with the axle hole of the fixed base.

6. The sheath type rotating axle structure as defined in claim 1, wherein the axle receiver is further disposed with a connection end which is disposed with at least a connection hole, and the fixed base is further disposed with a linking end which is disposed at least a linking hole.

7. A sheath type rotating axle structure, comprising an axle receiver disposed with a slanted corner and having a notch formed therein;

a fixed base disposed with a slanted corner;

a sheath part disposed with a sheath end and an extending end, wherein a flute is formed at the sheath end and a rim and an annular groove are disposed between the sheath end and the extending end; and a pivotal axle pivotally connected the sheath end, disposed at its front end with a protruding ring, and embeddingly engaged at its rear end with an axle hole of a fixed base, wherein the extending end of the sheath part is securingly mounted onto the notch of the axle receiver and the protruding ring of the pivotal axle is abutted against the rim and the annular groove of the sheath part;

such that the sheath part can generate frictional torque against the pivotal axle when the axle receiver is rotated with respect to the fixed base.

8. The sheath type rotating axle structure as defined in claim 7, wherein the axle receiver is further disposed with a stopping portion on one end and the fixed base is further disposed with a locating part, such that when the axle receiver is rotated with respect to the fixed base, the locating part of the fixed base is abutted against the stopping portion of the axle receiver to limit the rotating angle of the pivotal axle.

9. The sheath type rotating axle structure as defined in claim 7, wherein the axle receiver is further disposed with a stopping portion on one end and, a plurality of pin holes are annularly formed on the fixed base for inserting a locating pin and adjusting its inserting position of the locating part, such that when the axle receiver is rotated with respect to the fixed base, the locating pin is abutted against the stopping portion so as to limit the rotating angle of the pivotal axle.

10. The sheath type rotating axle structure as defined in claim 7, wherein the axle receiver is further disposed with a connection end which is disposed with at least a connection hole, and the fixed base is further disposed with a linking end which is disposed at least a linking hole.

* * * * *